US006592471B1

(12) United States Patent
Watanabe et al.

(10) Patent No.: US 6,592,471 B1
(45) Date of Patent: Jul. 15, 2003

(54) MULTI-PIECE SOLID GOLF BALL

(75) Inventors: Hideo Watanabe, Chichibu (JP); Yasumasa Shimizu, Chichibu (JP); Akira Kawata, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 30 days.

(21) Appl. No.: 09/657,940

(22) Filed: Sep. 8, 2000

(30) Foreign Application Priority Data

Sep. 14, 1999 (JP) ..... 11-259851

(51) Int. Cl.[7] ..... A63B 37/04; A63B 37/06; A63B 37/12; A63B 37/14; A63B 37/00

(52) U.S. Cl. ..... 473/377; 473/371; 473/378; 473/351

(58) Field of Search ..... 473/371, 372, 473/373, 374, 376, 377, 378

(56) References Cited

U.S. PATENT DOCUMENTS

| | | | | |
|---|---|---|---|---|
| 5,439,227 A | | 8/1995 | Egashira et al. | |
| 5,556,098 A | * | 9/1996 | Higuchi et al. | 473/373 |
| 5,704,854 A | | 1/1998 | Higuchi et al. | |
| 5,730,664 A | * | 3/1998 | Asakura et al. | 473/373 |
| 5,756,583 A | * | 5/1998 | Egashira et al. | 473/372 |
| 5,830,085 A | * | 11/1998 | Higuchi et al. | 473/373 |
| 5,876,294 A | * | 3/1999 | Yamagishi et al. | 473/374 |
| 6,126,558 A | * | 10/2000 | Higuchi et al. | 473/374 |
| 6,190,269 B1 | * | 2/2001 | Moriyama | 473/373 |
| 6,244,978 B1 | * | 6/2001 | Higuchi et al. | 473/374 |
| 6,254,495 B1 | * | 7/2001 | Nakamura et al. | 473/371 |
| 6,336,872 B1 | * | 1/2002 | Moriyama et al. | 473/374 |

FOREIGN PATENT DOCUMENTS

| | | |
|---|---|---|
| JP | 6-142228 | 5/1994 |
| JP | 9-10358 | 1/1997 |
| JP | 2 658 811 | 6/1997 |
| JP | 10-249259 | 3/2000 |

OTHER PUBLICATIONS

Callister, Jr., William D., Materials Scienve and Engineering: An Introduction, 4th Edition., New York: John Wiley & Sons, Inc., copyright 1997, p. 488.*

* cited by examiner

*Primary Examiner*—Paul T. Sewell
*Assistant Examiner*—Alvin A. Hunter, Jr.
(74) *Attorney, Agent, or Firm*—Sughrue Mion, PLLC

(57) ABSTRACT

In a golf ball comprising a solid core, a mantle, and a cover, the mantle is formed of a thermoplastic elastomer having a Shore D hardness of 30–52, the cover is formed of a thermoplastic resin loaded with a particulate inorganic filler, the solid core has a surface JIS C hardness 10–22 units greater than a center JIS C hardness, and the golf ball has an inertia moment of 82.5–85.5 kg·cm$^2$. The ball is improved in durability and feel when hit with clubs of different types.

14 Claims, 1 Drawing Sheet

MULTI-PIECE SOLID GOLF BALL

This invention relates to a multi-piece solid golf ball comprising a solid core, a mantle, and a cover, which is improved in durability and feel.

BACKGROUND OF THE INVENTION

One of the traditional requirements on golf balls is a pleasant feel when hit with clubs. A number of attempts have been made to provide a soft feel by reducing the hardness of the cover. Making the cover soft provides a soft feel at the sacrifice of distance. It is generally believed that the cover must be hard for the purpose of increasing the distance. However, a hard cover detracts from the feel especially on approach shots and putting. It is thus believed difficult in the prior art to improve both the feel and distance of golf balls.

SUMMARY OF THE INVENTION

An object of the invention is to provide a new and improved golf ball which offers a pleasant feel when hit with a variety of clubs and is improved in distance, durability, and spin.

The invention is directed to a multi-piece solid golf ball comprising a solid core, a mantle of at least one layer enclosing the solid core, and a cover of at least one layer enclosing the mantle. It has been found that improvements are made by forming the mantle relatively soft, forming the cover as a highly resilient hard layer loaded with a filler of specific shape, and optimizing the hardness distribution of the core and the inertia moment of the ball. Specifically, on driver shots, a pleasant feel is obtained, and the spin rate is reduced and the reduced spin is maintained during flight, so further distance is expected. Despite the hard cover, a very soft, pleasant feel is obtained on approach shots and putting. Additionally, the lowering of crack resistance by repetitive strikes is minimized.

The invention provides a golf ball comprising a solid core, a mantle of at least one layer enclosing the solid core, and a cover of at least one layer enclosing the mantle, wherein the mantle is formed mainly of a thermoplastic elastomer having a Shore D hardness of 30 to 52. The cover is formed of a composition comprising a thermoplastic resin as a main component and a particulate inorganic filler. The solid core has a JIS C hardness at its surface and a JIS C hardness at its center, the former being at least 10 units greater than the latter. The golf ball has an inertia moment of at least 82.5 $g \cdot cm^2$, and especially at least 83.0 $g \cdot cm^2$.

Preferably the cover composition contains 100 parts by weight of the thermoplastic resin and 11 to 45 parts by weight of the particulate inorganic filler; and the thermoplastic resin in the cover composition has a Shore D hardness of at least 60. The mantle preferably has a specific gravity of at least 0.8 and a gage of 0.2 to 5.0 mm.

BRIEF DESCRIPTION OF THE DRAWINGS

These and other objects, features and advantages of the present invention will be apparent with reference to the following description and drawing.

The only figure.

DESCRIPTION OF THE PREFERRED EMBODIMENT

Figure 1:
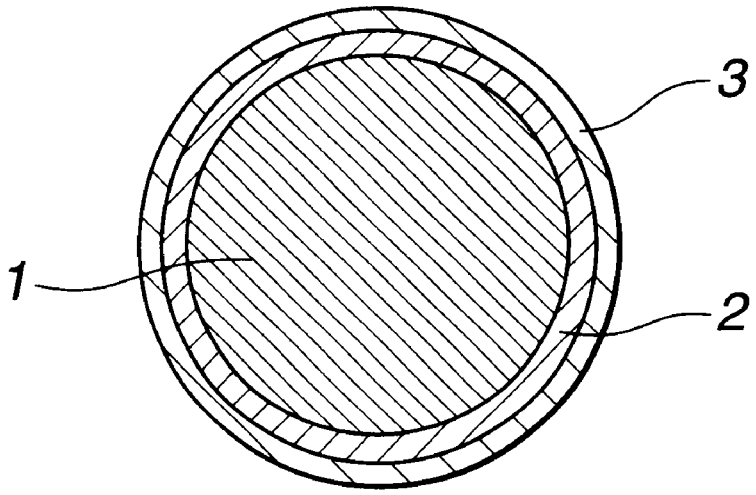
FIG. 1, is a schematic cross-sectional view of a three-piece solid golf ball according to one embodiment of the invention.

Referring to FIG. 1, a three-piece solid golf ball is illustrated as a typical example of the golf ball of the invention and as comprising a solid core 1, a mantle 2 enclosing the core, and a cover 3 enclosing the mantle, all disposed in a concentric fashion. In the figure, the core, mantle and cover each are illustrated as a single layer although it may have a multilayer structure of two or more layers.

Solid Core

The solid core 1 may be formed of any well-known rubber composition, preferably a composition comprising polybutadiene as base rubber. The preferred polybutadiene is 1,4-cis-polybutadiene containing at least 40% of cis configuration.

In the rubber composition, a crosslinking agent may be blended. Exemplary crosslinking agents include zinc and magnesium salts of unsaturated fatty acids such as zinc dimethacrylate and zinc diacrylate and esters such as trimethylpropane methacrylate. Zinc diacrylate is especially preferred for high restitution. The crosslinking agent is preferably used in an amount of about 10 to 35 parts by weight per 100 parts by weight of the base rubber.

A vulcanizing agent is usually blended in the rubber composition. Typical vulcanizing agents are dicumyl peroxide and a mixture of dicumyl peroxide and 1,1-bis(t-butylperoxy)-3,3,5-trimethylcyclohexane. The vulcanizing agent may be blended in an amount of about 0.1 to 5 parts by weight per 100 parts by weight of the base rubber. Dicumyl peroxide is commercially available, for example, in the name of Percumyl D from Nippon Oil and Fats K.K.

If necessary, there are blended an antioxidant and a filler for specific gravity adjustment such as zinc oxide and barium sulfate. Such a filler is blended in an amount of 0 to about 130 parts by weight per 100 parts by weight of the base rubber.

The solid core is generally prepared from the above-described rubber composition by mixing the ingredients in a conventional mixer (e.g., Banbury mixer, kneader or roll mill), and molding the resulting compound in a core-forming mold, typically by injection molding or compression molding.

The solid core thus obtained usually has a diameter of at least 32.0 mm, preferably at least 35.0 mm and up to 38.7 mm, preferably up to 37.0 mm. As to the specific gravity of the solid core, it is recommended, though not critical, that the specific gravity is at least 1.0, especially at least 1.08 and up to 1.2, especially up to 1.17. It is also preferred that the specific gravity of the solid core be optimized relative to the specific gravity of the mantle (to be described later).

The solid core used herein should have an optimum hardness distribution in a radial direction from its center to its surface in that the JIS C hardness at the surface is greater than the JIS C hardness at the center. The difference in JIS C hardness between the surface and the center of the solid core should be at least 10 units, preferably at least 12 units and also preferably up to 22 units, more preferably up to 20 units of JIS C hardness. If the hardness difference is below the limit, the ball may receive too much spin and thus travel shorter. If the hardness difference is too great, there arises a concern about durability being degraded, which does not become a substantial issue in the practice of the invention because the particulate inorganic filler in the cover (to be described later) compensates for the degradation of durability.

In the golf ball of the invention, the solid core should preferably have a deflection of 3.2 to 4.7 mm, more preferably 3.5 to 4.2 mm under a load of 100 kg. With less deflection, the ball, when hit with a driver, would give a hard feel and receive more spin so that the ball may sky high, resulting in a reduced distance. With an excessive deflection, the ball, when hit with a driver, would give a dull feel and become less resilient, also leading to a reduced distance.

It is noted that the solid core can be formed of a material other than the above-described rubber composition as long as the core is given an optimum hardness difference between the center and the surface as mentioned above. A choice may be made of thermoplastic elastomers and thermoplastic resins which will be exemplified later in conjunction with the mantle and cover.

The solid core may be either a single layer of a single material or a multilayer structure of two or more stacked layers of different materials. In the event where the solid core has a multilayer structure of two or more layers, the surface hardness and the center hardness should be adjusted so as to provide a difference of at least 10 JIS C hardness units.

Mantle

The mantle 2 is an intermediate layer formed around the solid core 1. The mantle should be formed mainly of a relatively soft thermoplastic elastomer having a Shore D hardness of at least 30, preferably at least 36 and up to 52, preferably up to 50, more preferably up to 47.

The thermoplastic elastomers used herein include thermoplastic polyester, polyamide, polyurethane, olefin, and styrene elastomers. They are commercially available, for example, in the trade name of Hytrel from Dupont-Toray K.K., Pebax from Toray K.K., Pandex from Dai-Nippon Ink & Chemicals K.K., Santoplane from Monsanto Co. and Toughtec from Asahi Chemicals K.K.

The mantle may be formed by injecting molding the elastomer material. Specifically, the preformed solid core is held in place in an injection mold and the elastomer material is injected into the mold. Alternatively, a pair of half cups are formed from the elastomer material, and the solid core is encased with the pair of half cups, which are compression molded in a mold under heat and pressure.

It is recommended, though not critical, that the mantle have a gage or radial thickness of at least 0.2 mm, especially at least 0.8 mm and up to 5.0 mm, especially up to 2.0 mm.

It is also recommended, though not critical, that the mantle have a specific gravity of at least 0.8, especially at least 1.0 and up to 1.4, especially up to 1.2. If the specific gravity of the mantle is low, it may become necessary to increase the specific gravity of the core or cover. Increasing the cover's specific gravity too much may lead to a loss of resilience, and increasing the core's specific gravity too much may lead to a lower inertia moment and hence, a shorter flight distance.

Preferably, the specific gravity of the mantle is optimized in harmony with the specific gravity of the solid core. Specifically the difference between the mantle's specific gravity and the solid core's specific gravity (i.e., mantle's specific gravity minus solid core's specific gravity) is at least −0.05, especially at least −0.04 and up to 0.10, especially up to 0.08. If the specific gravity difference is outside the range, there is a likelihood that the ball might have a reduced inertia moment and resilience and travel short.

Cover

In the golf ball of the invention, the cover 3 is formed on the surface of the mantle 2. The cover is formed of a composition based on a thermoplastic resin and having a particulate inorganic filler blended therein.

The thermoplastic resin used as the base of the cover is typically an ionomer resin, though not limited thereto. As the cover base, the thermoplastic resin loaded with the particulate inorganic filler should preferably have a Shore D hardness of at least 60, especially at least 62 and up to 67, especially up to 65. A lower Shore D hardness may sometimes invite a loss of resilience, an increase of spin and a shorter distance. The thermoplastic resins are commercially available, for example, in the trade name of Himilan (ionomer resins by Dupont-Mitsui K.K.), Surlyn (ionomer resins by Dupont) and Iotek (ionomer resin by Exxon Chemical).

In the cover composition, the particulate inorganic filler is blended for restraining the degradation of durability by the hardness distribution difference of the solid core. The inorganic filler used herein may be selected, for example, from barium sulfate and titanium dioxide. The use of precipitating barium sulfate is recommended because it can impart good durability regardless of the hardness distribution of the solid core.

The inorganic filler can be surface treated so that it may readily disperse in the ionomer resin.

The inorganic filler used herein is particulate. The term "particulate" denotes particles having a mean particle size of at least 0.1 $\mu$m, especially at least 0.3 $\mu$m and up to 5 $\mu$m, especially up to 2 $\mu$m. The shape of particles is not limited to spherical. Particles of any other or irregular shape are acceptable as long as the mean particle size falls within the above range.

Preferably the particulate inorganic filler is blended in amounts of at least 11 parts, especially at least 14 parts by weight and up to 45 parts, especially up to 30 parts by weight per 100 parts by weight of the thermoplastic resin. Less amounts of the filler may fail to restrain the degradation of durability. Excessive amounts of the filler may detract from resilience and hence, distance.

In forming the cover from the above material, injection or compression molding may be used like the mantle. For example, the core having the mantle formed thereon is held in place in a mold, and the cover material is injection molded into the mold.

The cover preferably has a gage or radial thickness of at least 0.2 mm, especially at least 1.0 mm and up to 5.0 mm, especially up to 2.5 mm, though not limited thereto.

From the standpoint of optimizing the inertia moment, it is preferred that the cover have a specific gravity of at least 1.03, especially at least 1.05 and up to 1.30, especially up to 1.25, though not limited thereto.

Where the cover is composed of two or more layers of different materials, the cover as a whole should preferably have a gage and hardness in the above ranges.

The golf ball of the invention should have an inertia moment which can maintain the spin rate constant. The inertia moment used herein is calculated by the following expression.

$$M=(\pi/5880000)\times\{(r_1-r_2)\times D_1^5+(r_2-r_3)\times D_2^5+r_3\times D_3^5\}$$

M: inertia moment $r_1$: core specific gravity $D_1$: core diameter $r_2$: mantle specific gravity $D_2$: (core+mantle) diameter $r_3$: cover specific gravity (calculated)

$D_3$: ball diameter

Namely, the inertia moment is calculated from the diameter (gage) and specific gravity of the respective layers, provided that the ball is a true sphere. Assume that a "spherical body" consists of the core and the mantle and the completed ball defines a "true sphere" when the ball surface is free of dimples. Then, the specific gravity of the cover is calculated by subtracting the weight of the spherical body from the weight of the completed ball to give a cover weight, subtracting the volume of the spherical body from the volume of the true sphere to give a cover volume, and dividing the cover weight by the cover volume, as shown below.

$r_3$=(weight of complete ball−weight of spherical body)/(volume of true sphere−volume of spherical body)

The inertia moment M is calculated using these parameters.

The golf ball of the invention should have an inertia moment of at least 82.5 g $cm^2$, especially at least 83.0 g·$cm^2$, as calculated according to the above expression, and the upper limit is preferably 85.5 g·$cm^2$. With a less inertia moment, the ball in flight fails to maintain the spin, resulting in a shorter distance. With an excessive inertia moment, the ball becomes less resilient, failing to travel a distance.

Like conventional golf balls, the golf ball of the invention is provided on the surface with a multiplicity of dimples. If necessary, the surface of the ball is subjected to finishing treatments such as painting and stamping.

While the solid golf ball of the invention is constructed as mentioned above, ball specifications including weight and diameter are properly determined in accordance with the Rules of Golf. The ball has a diameter of not less than 42.67 mm and a weight of not greater than 45.93 g.

The golf ball of the invention has improved durability and a pleasant feel when hit with clubs of different types. Especially on driver shots, the ball receives a reduced spin rate and an increased initial velocity and hence, travels a longer distance.

EXAMPLE

Examples of the invention are given below by way of illustration and not by way of limitation.

Examples 1–7 and Comparative Examples 1–10

Each of rubber compositions of the formulation shown in Tables 1 and 2 was admitted into a mold where the composition was molded into a solid core having a hardness distribution as shown in Tables 1 and 2. Using resin and rubber compositions of the formulation shown in Tables 3 and 4, a mantle and a cover were formed in accordance with Tables 5 and 6. In this way, there were produced golf balls having dimples of the same shape and arrangement on the surface.

The trade names shown in Table 3 designate the following materials.

Hytrel: thermoplastic polyester elastomer, Dupont-Toray K.K.

Toughtec: thermoplastic styrene elastomer, Asahi Chemicals K.K.

Himilan: ionomer resin, Dupont-Mitsui Polychemical K.K.

Surlyn: ionomer resin, Dupont

Barium Sulfate 300: barium sulfate (true specific gravity 4.4), Sakai Chemical K.K.

The following measurement and tests were carried out on the golf balls. The results are shown in Tables 5 and 6.

Inertia Moment calculated according to the above expression.

Flight Performance

Using a swing robot, the ball was hit with a driver (#1W) at a head speed (HS) of 45 m/s. A spin rate, carry and total distance (carry+run) were measured. The overall flight performance was rated according to the following criterion while comparing the total distance (D) with the total distance of Comparative Example 1.

⊙: excellent flight (225 m≦D)

○: good flight (221 m≦D<225 m)

Δ: average flight (218 m≦D<221 m)

X: poor flight (D<218 m)

Feel

While the ball was hit with a driver (#1W), No. 9 iron (#9I), and putter (PT), its feel was rated according to the following criterion.

○: soft, pleasant feel

Δ: average feel

X: unpleasant feel

Durability Against Repetitive Hits

Using the swing robot, the ball was hit repetitively 200 times with a driver (#1W) at a head speed of 45 m/s. The number of hits repeated until the ball cracked was reported.

○: not cracked until 200 hits

Δ: cracked between 100 and 199 hits

X: cracked before 100 hits

TABLE 1

| Core | Example | | | | | | |
|---|---|---|---|---|---|---|---|
| composition (pbw) | 1 | 2 | 3 | 4 | 5 | 6 | 7 |
| Polybutadiene | 100 | 100 | 100 | 100 | 100 | 100 | 100 |
| Zinc diacrylate | 31.5 | 28 | 23.5 | 28 | 28 | 28 | 26.5 |
| Dicumyl peroxide | 1 | 1 | 1 | 1 | 1 | 1 | 1 |
| Antioxidant | 0.1 | 0.1 | 0.1 | 0.1 | 0.1 | 0.1 | 0.1 |
| Barium sulfate | 2.4 | 4.1 | 6.3 | 3.2 | 15.2 | 2.1 | 5.8 |
| Zinc oxide | 5 | 5 | 5 | 5 | 5 | 5 | 5 |
| Zinc salt of pentachlorothiophenol | 1 | 1 | 1 | 1 | 1 | 1 | 1 |
| Vulcanizing conditions | | | | | | | |
| Temperature (° C.) | 155 | 155 | 155 | 155 | 155 | 155 | 155 |
| Time (min) | 20 | 20 | 20 | 20 | 20 | 20 | 20 |
| Core hardness (JIS C) | | | | | | | |
| H1: Surface hardness | 81 | 76 | 75 | 76 | 76 | 76 | 76 |
| H2: Center hardness | 65 | 64 | 60 | 64 | 64 | 64 | 62 |
| H1 − H2 | 16 | 12 | 15 | 12 | 12 | 12 | 14 |

TABLE 2

| | Comparative Example | | | | | | | | | |
|---|---|---|---|---|---|---|---|---|---|---|
| Core composition (pbw) | 1 | 2 | 3 | 4 | 5 | 6 | 7 | 8 | 9 | 10 |
| Polybutadiene | 100 | 100 | 100 | 100 | 100 | 100 | 100 | 100 | 100 | 100 |
| Zinc diacrylate | 23.5 | 22 | 31.5 | 38 | 36 | 32.5 | 21.5 | 31.5 | 28 | 21.5 |
| Dicumyl peroxide | 1 | 1 | 1 | 1 | 1 | 1 | 1 | 1 | 1 | 1 |
| Antioxidant | 0.1 | 0.1 | 0.1 | 0.1 | 0.1 | 0.1 | 0.1 | 0.1 | 0.1 | 0.1 |
| Barium sulfate | 23.6 | 22.7 | 2.4 | 1.17 | 10.41 | 24.82 | 19.72 | 9.97 | 16.08 | 13.2 |
| Zinc oxide | 5 | 5 | 5 | 5 | 5 | 5 | 5 | 5 | 5 | 5 |
| Zinc salt of pentachlorothiophenol | 1 | 0.1 | 1 | 0.1 | 1 | 1 | 0.1 | 1 | 1 | 0.2 |
| Primary vulcanizing conditions | | | | | | | | | | |
| Temperature (° C.) | 155 | 155 | 145 | 160 | 155 | 155 | 155 | 155 | 155 | 155 |
| Time (min) | 20 | 15 | 30 | 15 | 20 | 20 | 15 | 20 | 20 | 15 |
| Secondary vulcanizing conditions | | | | | | | | | | |
| Temperature (° C.) | | | 170 | | | | | | | |
| Time (min) | | | 10 | | | | | | | |
| Core hardness (JIS C) | | | | | | | | | | |
| H1: Surface hardness | 75 | 72 | 73 | 90 | 92 | 82 | 75 | 81 | 76 | 74 |
| H2: Center hardness | 60 | 60 | 70 | 70 | 70 | 67 | 55 | 65 | 64 | 54 |
| H1 − H2 | 15 | 12 | 3 | 20 | 22 | 15 | 20 | 16 | 12 | 20 |

TABLE 3

| Mantle/Cover composition (pbw) | a | b | c | d | e | f | g | h | i | j |
|---|---|---|---|---|---|---|---|---|---|---|
| Hytrel 3078 | 100 | | | | | | | | | |
| Hytrel 4047 | | 100 | | | | | | | | |
| Hytrel 4767 | | | 100 | | | | | | | |
| Toughtec M1943 | | | | 100 | | | | | | |
| Himilan 1706 | | | | | 50 | | | | | |
| Himilan 1557 | | | | | | 50 | | 50 | 50 | |
| Himilan 1650 | | | | | | | 60 | | | 40 |
| Himilan 1605 | | | | | 50 | | | | | |
| Himilan 1601 | | | | | | 50 | | 50 | 50 | |
| Surlyn 8120 | | | | | | | 40 | | | 60 |
| Barium Sulfate 300 | | | | | | | | 27 | 13.5 | |
| Titanium dioxide | | | | | 5.6 | 5.6 | 5.6 | 5.6 | 5.6 | 5.6 |
| Resin hardness (Shore D) | 30 | 40 | 47 | 25 | 63 | 60 | 56 | 62 | 61 | 53 |
| Specific gravity | 1.08 | 1.12 | 1.16 | 0.90 | 0.99 | 0.96 | 0.98 | 1.17 | 1.07 | 0.99 |

TABLE 4

| Mantle composition (pbw) | | k |
|---|---|---|
| Polybutadiene | | 100 |
| Zinc diacrylate | | 34 |
| Dicumyl peroxide | | 1 |
| Antioxidant | | 0.1 |
| Barium sulfate | | 22.12 |
| Zinc oxide | | 5 |
| Zinc salt of pentachlorothiophenol | | 1 |
| Vulcanizing conditions | Temperature (° C.) | 155 |
| | Time (min) | 20 |
| Surface hardness (Shore D) | | 55 |
| Specific gravity | | 1.17 |

TABLE 5

| | Example | | | | | | |
|---|---|---|---|---|---|---|---|
| | 1 | 2 | 3 | 4 | 5 | 6 | 7 |
| Core | | | | | | | |
| Weight (g) | 25.25 | 25.25 | 25.25 | 26.10 | 26.68 | 24.98 | 26.36 |
| Diameter (mm) | 35.25 | 35.25 | 35.25 | 35.7 | 35.25 | 35.25 | 35.7 |
| Deflection under 100 kg (mm) | 3.5 | 4.0 | 4.5 | 4.0 | 4.0 | 4.0 | 4.2 |
| Specific gravity | 1.10 | 1.10 | 1.10 | 1.10 | 1.16 | 1.09 | 1.11 |
| Mantle | | | | | | | |
| Type | b | b | b | b | b | c | a |
| Shore D hardness | 40 | 40 | 40 | 40 | 40 | 47 | 30 |
| Weight (g) | 33.3 | 33.3 | 33.3 | 33.3 | 33.3 | 33.3 | 33.3 |
| Outer diameter (mm) | 38.6 | 38.6 | 38.6 | 38.6 | 38.6 | 38.6 | 38.6 |
| Gage (mm) | 1.68 | 1.68 | 1.68 | 1.45 | 1.68 | 1.68 | 1.45 |
| Cover | | | | | | | |
| Type | h | h | h | h | i | h | h |
| Gage (mm) | 2.05 | 2.05 | 2.05 | 2.05 | 2.05 | 2.05 | 2.05 |
| Shore D hardness | 62 | 62 | 62 | 62 | 61 | 62 | 62 |
| Mantle specific gravity – core specific gravity | 0.02 | 0.02 | 0.02 | 0.03 | −0.04 | 0.07 | −0.03 |
| Ball | | | | | | | |
| Weight (g) | 45.3 | 45.3 | 45.3 | 45.3 | 45.6 | 45.3 | 45.3 |
| Diameter (mm) | 42.7 | 42.7 | 42.7 | 42.7 | 42.7 | 42.7 | 42.7 |
| Inertia moment (kg · $cm^2$) | 84.7 | 84.7 | 84.7 | 84.5 | 83.5 | 85.0 | 84.3 |
| #1W/HS = 45 | | | | | | | |
| Carry (m) | 209.3 | 208.2 | 207.0 | 208.5 | 207.5 | 210.0 | 207.1 |
| Total (m) | 224.3 | 223.2 | 222.1 | 223.5 | 222.6 | 225.1 | 221.0 |
| Flight performance | ○ | ○ | ○ | ○ | ○ | ◎ | ○ |
| Spin (rpm) | 2790 | 2715 | 2640 | 2700 | 2695 | 2645 | 2785 |
| Feel | ○ | ○ | ○ | ○ | ○ | ○ | ○ |
| #9I | | | | | | | |
| Feel | ○ | ○ | ○ | ○ | ○ | ○ | ○ |
| PT | | | | | | | |
| Feel | ○ | ○ | ○ | ○ | ○ | Δ | ○ |
| Durability against repetitive hits | ○ | ○ | ○ | ○ | ○ | ○ | ○ |

TABLE 6

| | Comparative Example | | | | | | | | | |
|---|---|---|---|---|---|---|---|---|---|---|
| | 1 | 2 | 3 | 4 | 5 | 6 | 7 | 8 | 9 | 10 |
| Core | | | | | | | | | | |
| Weight (g) | 27.50 | 27.23 | 25.25 | 15.2 | 30.7 | 29.2 | 34.9 | 26.2 | 26.8 | 34.1 |
| Diameter (mm) | 35.25 | 35.25 | 35.25 | 29.7 | 37.0 | 35.7 | 38.5 | 35.25 | 35.25 | 38.6 |
| Deflection under 100 kg (mm) | 4.5 | 4.5 | 3.5 | 2.5 | 2.6 | 3.1 | 4.3 | 3.5 | 4.0 | 4.5 |
| Specific gravity | 1.20 | 1.19 | 1.10 | 1.11 | 1.16 | 1.23 | 1.17 | 1.14 | 1.17 | 1.13 |
| Mantle | | | | | | | | | | |
| Type | b | b | b | k | b | g | | h | d | |
| Shore D hardness | 40 | 40 | 40 | 55 | 40 | 56 | | 55 | 25 | |
| Weight (g) | 35.5 | 35.5 | 33.3 | 35.4 | 38.5 | 38.7 | | 33.3 | 33.3 | |
| Outer diameter (mm) | 38.6 | 38.6 | 38.6 | 38.7 | 40.0 | 40.0 | | 38.6 | 38.6 | |
| Gage (mm) | 1.68 | 1.68 | 1.68 | 4.50 | 1.50 | 2.15 | | 1.68 | 1.68 | |
| Cover | | | | | | | | | | |
| Type | f | e | h | e | j | f | e | h | h | i |
| Gage (mm) | 2.05 | 2.05 | 2.05 | 2.00 | 1.35 | 1.35 | 2.10 | 2.05 | 2.05 | 2.10 |
| Shore D hardness | 60 | 63 | 62 | 63 | 53 | 60 | 63 | 62 | 62 | 61 |
| Mantle specific gravity – core specific gravity | −0.08 | −0.07 | 0.02 | 0.11 | −0.04 | −0.25 | | −0.16 | −0.27 | |
| Ball | | | | | | | | | | |

TABLE 6-continued

| | Comparative Example | | | | | | | | | |
|---|---|---|---|---|---|---|---|---|---|---|
| | 1 | 2 | 3 | 4 | 5 | 6 | 7 | 8 | 9 | 10 |
| Weight (g) | 45.3 | 45.3 | 45.3 | 45.3 | 45.3 | 45.3 | 45.3 | 45.3 | 45.3 | 45.3 |
| Diameter (mm) | 42.7 | 42.7 | 42.7 | 42.7 | 42.7 | 42.7 | 42.7 | 42.7 | 42.7 | 42.7 |
| Inertia moment (kg · cm$^2$) | 81.5 | 81.8 | 84.7 | 83.0 | 82.4 | 80.5 | 82.0 | 83.6 | 83.0 | 83.4 |
| #1W/HS = 45 | | | | | | | | | | |
| Carry (m) | 205.4 | 207.5 | 208.5 | 207.5 | 208.1 | 208.9 | 205.7 | 209.2 | 207.9 | 205.2 |
| Total (m) | 217.5 | 222.0 | 217.1 | 218.8 | 219.2 | 219.6 | 222.0 | 222.6 | 217.9 | 220.5 |
| Flight performance | X | ○ | X | Δ | Δ | Δ | ○ | ○ | X | Δ |
| Spin (rpm) | 2680 | 2620 | 2990 | 2800 | 3030 | 2740 | 2550 | 2640 | 2865 | 2555 |
| Feel | Δ | ○ | ○ | X | X | Δ | ○ | Δ | ○ | ○ |
| #9I | | | | | | | | | | |
| Feel | ○ | ○ | ○ | X | Δ | Δ | Δ | X | ○ | Δ |
| PT | | | | | | | | | | |
| Feel | ○ | ○ | ○ | X | Δ | Δ | Δ | X | ○ | Δ |
| Durability against repetitive hits | ○ | Δ | ○ | ○ | ○ | ○ | X | ○ | ○ | ○ |

As seen from Tables 5 and 6, the golf balls within the scope of the invention are excellent in all of flight performance, feel when hit with clubs of different types, and durability against repetitive hits. By contrast, the golf balls of Comparative Examples had the following drawbacks.

Comparative Example 1

The distance on driver shot was short. The feel on driver shot was too soft.

Comparative Example 2 poor durability

Comparative Example 3 short distance

Comparative Example 4 short distance, hard feel

Comparative Example 5 short distance, unpleasant feel

Comparative Example 6 short distance, unpleasant feel

Comparative Example 7

The feel on iron and putter shots was inferior. Durability was poor.

Comparative Example 8 inferior feel

Comparative Example 9 short distance

Comparative Example 10

The feel on iron and putter shots was inferior. Flight performance was poor.

Japanese Patent Application No. 11-259851 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A golf ball, comprising a solid core, a mantle of at least one layer enclosing said solid core, and a cover of at least one layer enclosing said mantle, wherein:

said mantle is formed mainly of a thermoplastic elastomer having a Shore D hardness of 30 to 52;

said cover is formed of a composition contains 100 parts by weight of a thermoplastic resin as a main component and 11 to 45 parts by weight of barium sulfate being a particulate inorganic filler, and wherein said cover has a specific gravity of from 1.03 to 1.30;

said solid core has a JIS C hardness at its surface of at least 10 units greater than a JIS C hardness at its center;

said golf ball has an inertia moment of at least 82.5 g·cm$^2$; and said thermoplastic resin in the cover composition has a Shore D hardness of at least 60.

2. The golf ball of claim 1 which has an inertia moment of at least 83.0 g·cm$^2$.

3. The golf ball of claim 1, wherein said mantle has a specific gravity of at least 0.8 and a gage of 0.2 to 5.0 mm.

4. The golf ball of claim 1, wherein said solid core has a multilayer structure.

5. The golf ball of claim 1, wherein said mantle has a Shore D hardness of 36 to 47.

6. The golf ball of claim 1, wherein a difference between respective specific gravities of said mantle and said solid core is at least −0.05.

7. The golf ball of claim 6, wherein said difference is in a range from −0.04 to 0.08.

8. The golf ball of claim 1, wherein said particulate inorganic filler is one of barium sulfate and titanium dioxide.

9. The golf ball of claim 1, wherein the particles of said particulate inorganic filler have a mean particle size of from 0.1 to 2 $\mu$m.

10. The golf ball of claim 1, wherein the mantle is formed mainly of a thermoplastic polyester elastomer.

11. The golf ball of claim 2, wherein the gage of the mantle is not more than 1.68 mm.

12. The golf ball of claim 1, wherein the added amount of the particulate inorganic filler is from 14 to 30 parts by weight.

13. The golf ball of claims 1, wherein the thermoplastic elastomers of the mantle is selected from polyamide elastomer, polyurethane elastomer, olefin elastomer, and stylene elastomer.

14. The golf ball of claim 1, wherein the specific gravity of the cover is from 1.05 to 1.25.

* * * * *